US009555936B2

(12) United States Patent
Martindale et al.

(10) Patent No.: US 9,555,936 B2
(45) Date of Patent: Jan. 31, 2017

(54) SCREW-ON BOTTLE INTERFACE FOR A BOTTLE SPOUT

(71) Applicant: Automatic Bar Controls, Inc., Vacaville, CA (US)

(72) Inventors: Richard A. Martindale, Vacaville, CA (US); Thomas R. Hecht, Winters, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 51 days.

(21) Appl. No.: 14/245,936

(22) Filed: Apr. 4, 2014

(65) Prior Publication Data

US 2014/0299636 A1 Oct. 9, 2014

Related U.S. Application Data

(60) Provisional application No. 61/808,901, filed on Apr. 5, 2013.

(51) Int. Cl.
*B65D 5/74* (2006.01)
*B65D 47/06* (2006.01)

(52) U.S. Cl.
CPC ..... *B65D 47/06* (2013.01)

(58) Field of Classification Search
CPC ..... B65D 25/48; B65D 47/06; B65D 41/26; B67D 2210/00091
USPC ..... 222/568, 566
See application file for complete search history.

(56) References Cited

U.S. PATENT DOCUMENTS

| | | | | | |
|---|---|---|---|---|---|
| 584,892 | A * | 6/1897 | Record | 222/489 |
| 2,445,130 | A * | 7/1948 | Turner | 141/290 |
| 2,714,977 | A * | 8/1955 | Davis | 222/424.5 |
| 3,061,151 | A * | 10/1962 | Clare | 222/478 |
| 3,235,133 | A * | 2/1966 | Zimmerman et al. | 222/478 |
| 3,321,113 | A * | 5/1967 | Conry | 222/477 |
| 4,349,042 | A * | 9/1982 | Shimizu | 137/39 |
| 4,398,652 | A * | 8/1983 | Ueda et al. | 222/1 |
| 4,427,138 | A * | 1/1984 | Heinlein | 222/546 |
| 4,583,668 | A * | 4/1986 | Maynard, Jr. | 222/529 |
| 4,667,853 | A * | 5/1987 | Krüger | 222/80 |
| 4,736,871 | A * | 4/1988 | Luciani et al. | 222/25 |
| D311,573 | S * | 10/1990 | Lewis | D23/262 |
| 5,044,521 | A * | 9/1991 | Peckels | 222/23 |
| 5,234,117 | A * | 8/1993 | Garvin | 215/11.4 |
| 5,803,310 | A * | 9/1998 | Soon | 222/1 |
| 5,961,008 | A * | 10/1999 | Peckels | 222/477 |
| 6,845,887 | B1 * | 1/2005 | Granger et al. | 222/153.06 |
| 7,237,692 | B2 * | 7/2007 | Bodum | 222/109 |
| 8,887,968 | B1 * | 11/2014 | Call | 222/568 |
| 2003/0029829 | A1 * | 2/2003 | Stephan | 215/387 |
| 2005/0167445 | A1 * | 8/2005 | Mochiachvili et al. | 222/113 |

(Continued)

*Primary Examiner* — Kevin P Shaver
*Assistant Examiner* — Michael J Melaragno
(74) *Attorney, Agent, or Firm* — Kilpatrick Townsend & Stockton LLP

(57) ABSTRACT

The present invention relates to a screw-on interface for bottle spouts that secures a spout to a bottle in a manner such that wear and/or breakage of the bottle interface from standard usage is minimized. In an embodiment of the invention, the screw-on bottle interface incorporates a stainless steel plate in its threaded collar. This plate prevents damage to both the spout and the screw-on bottle interface when users over-tighten a screw-on bottle interface equipped bottle spout during installation of the spout onto a bottle.

10 Claims, 3 Drawing Sheets

(56) References Cited

U.S. PATENT DOCUMENTS

| | | | | |
|---|---|---|---|---|
| 2006/0000855 | A1* | 1/2006 | Allen et al. | 222/484 |
| 2006/0027268 | A1* | 2/2006 | Zapp | 137/493.2 |
| 2006/0283882 | A1* | 12/2006 | Escobar et al. | 222/113 |
| 2008/0017675 | A1* | 1/2008 | Pressey | 222/481.5 |
| 2008/0073383 | A1* | 3/2008 | McDonald | 222/500 |
| 2008/0272147 | A1* | 11/2008 | Buker et al. | 222/113 |
| 2009/0277931 | A1* | 11/2009 | Zapp | 222/504 |
| 2011/0036873 | A1* | 2/2011 | Peckels | 222/476 |
| 2011/0163119 | A1* | 7/2011 | Nyambi et al. | 222/1 |
| 2011/0255996 | A1* | 10/2011 | Wickstead et al. | 417/53 |
| 2011/0309103 | A1* | 12/2011 | Heatherly et al. | 222/52 |
| 2012/0211516 | A1* | 8/2012 | Zapp et al. | 222/20 |
| 2013/0056502 | A1* | 3/2013 | Zapp | 222/500 |
| 2013/0334246 | A1* | 12/2013 | Houck et al. | 222/23 |
| 2014/0346198 | A1* | 11/2014 | Bond | 222/641 |

* cited by examiner

SCREW-ON BOTTLE INTERFACE FOR A BOTTLE SPOUT

CROSS-REFERENCE TO RELATED APPLICATIONS

The present patent application claims priority to U.S. provisional patent application 61/808,901 filed on Apr. 5, 2013, which is hereby incorporated by reference.

BACKGROUND OF THE INVENTION

The present invention relates in general to spouts configured to regulate liquid as poured from bottles. In particular, the present invention relates to a screw-on interface for bottle spouts that secures a spout to a bottle. During standard usage, a bottle spout is physically screwed onto a bottle by hand. If excessive force is applied to the bottle spout as it is attached onto a bottle, the bottle spout may experience breakage of its parts or may cease to function as required, regulating the flow of liquid out of a bottle without leakage. More specifically, inherent and common problems associated with conventional pour spout "corks" used on all pour spouts—be they static pour spouts or portion controllable pour spouts that are part of a liquor control system, include: compression and/or deformation of cork flange seal rings; cork slippage on the spout stem; inability to accommodate or adapt to inconsistent inside diameters of liquor bottles which vary 1 to 2 mm on the same size bottle of the same brand of liquor. The end result of these problems with conventional corks is an inability to force a cork into undersized bottle internal diameter, leading to an incomplete seal causing leakage when bottle inverted into a pour position. Further, there is a lack of an ability with a conventional cork-equipped spout to be moved from one bottle to the next without an improper fit occurring.

BRIEF SUMMARY OF THE INVENTION

The present invention relates to a screw-on interface for bottle spouts that secures a spout to a bottle in a manner such that wear and/or breakage of the bottle interface from standard usage is minimized. In an embodiment of the invention, the screw-on bottle interface incorporates a stainless steel plate in its threaded collar. This plate prevents damage to both the spout and the screw-on bottle interface when users over-tighten a screw-on bottle interface equipped bottle spout during installation of the spout onto a bottle.

The screw-on bottle interface is available as a complete assembly which includes the threaded collar, which can be chosen according to bottles with different diameters, a lens, two spacers, and a screw-on bottle interface cork. The screw-on bottle interface can be configured to fit with various spouts from multiple manufacturers without any retrofit of the bottle spouts required. The screw-on bottle interface can be configured with an appropriate adapter to fit the width and/or length of a bottle spout.

DETAILED DESCRIPTION OF THE INVENTION

Figure 1:
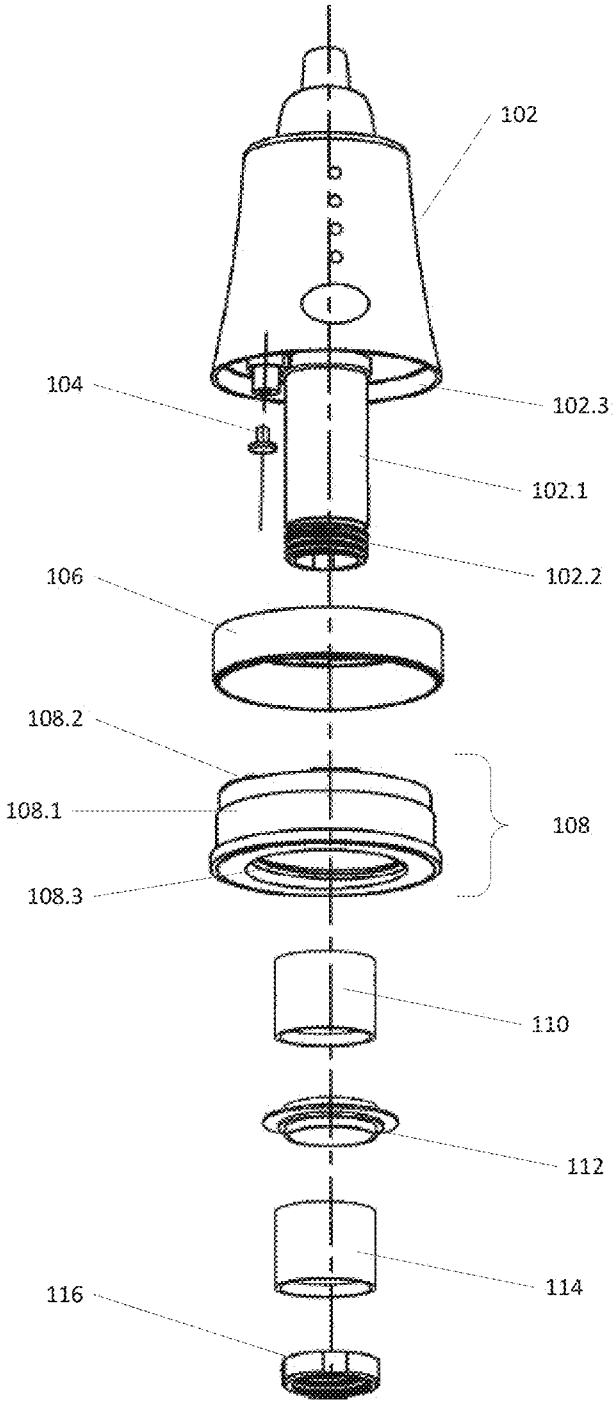
FIG. 1 shows an exploded view of a bottle spouts with a screw-on interface according to an embodiment of the invention.

FIG. 1 is an exploded view of a screw-on interface 100 for bottle spouts according to an embodiment of the invention. The components of the screw-on interface are configured to fit concentrically along the longitudinal axis of a bottle spout 102. The bottle spout 102 is a structure known in the art, which allows for liquid to pass through the bottle spout 102, regulated in part by a button cover 104, when a bottle is held in a manner to pour out liquids contained in the bottle. The screw-on interface 100 is mechanically connected to the bottle spout 102. The bottle spout 102 has a stem 102.1 which, when attached to a bottle, is positioned within an internal diameter of a bottle. The screw-on interface 100 has an assembly of a first spacer 110, a cork 112, and a second spacer 114 which fit around the bottle spout stem 102.1. The first spacer 110 and/or second spacer 114 are machined to have a counter-bore which attach and secure to the cork 112. The combined first spacer 110, cork 112, and second spacer 114 assembly are anchored and secured to the bottle spout stem 102.1 by a nut 116 which screws onto bottle spout stem threading 102.2. The cork 112 operates to seal the interior diameter of a bottle in which the bottle spout and screw-on interface 100 is inserted.

The bottle spout 102 further has an exterior shell rim 102.3 which when attached to a bottle, is positioned outside and surrounding an external diameter of a bottle. The bottle spout exterior shell rim 102.3 is mechanically coupled to the screw-on interface 100 at the lens 106. The lens 106 may be transparent or non-transparent and may operate as an extension piece, as a cover to obscure labels on a bottle, and/or provide a location for identification labels to be written, placed, or affixed. The lens 106 is mechanically coupled to a threaded collar 108, the threaded collar 108 being a four-piece assembly, ultrasonically welded together including a outer collar 108.1, a threaded insert 108.2, a gasket 108.3, and a disk (not shown). In embodiments of the invention, the disk may be made of stainless steel. In further embodiments of the invention, the disk may have a groove or depression in which the threaded insert 108.2 can reside. The threaded collar 108 can be provided with various threading patterns or sizes, including, for example, small (size 11), medium (size 31), large (size 41), or extra-large (size 51) so as to fit bottles of various diameters. The desired threading pattern can be selected by use of a particular threaded insert 108.2 appropriate for the application.

Figure 2:
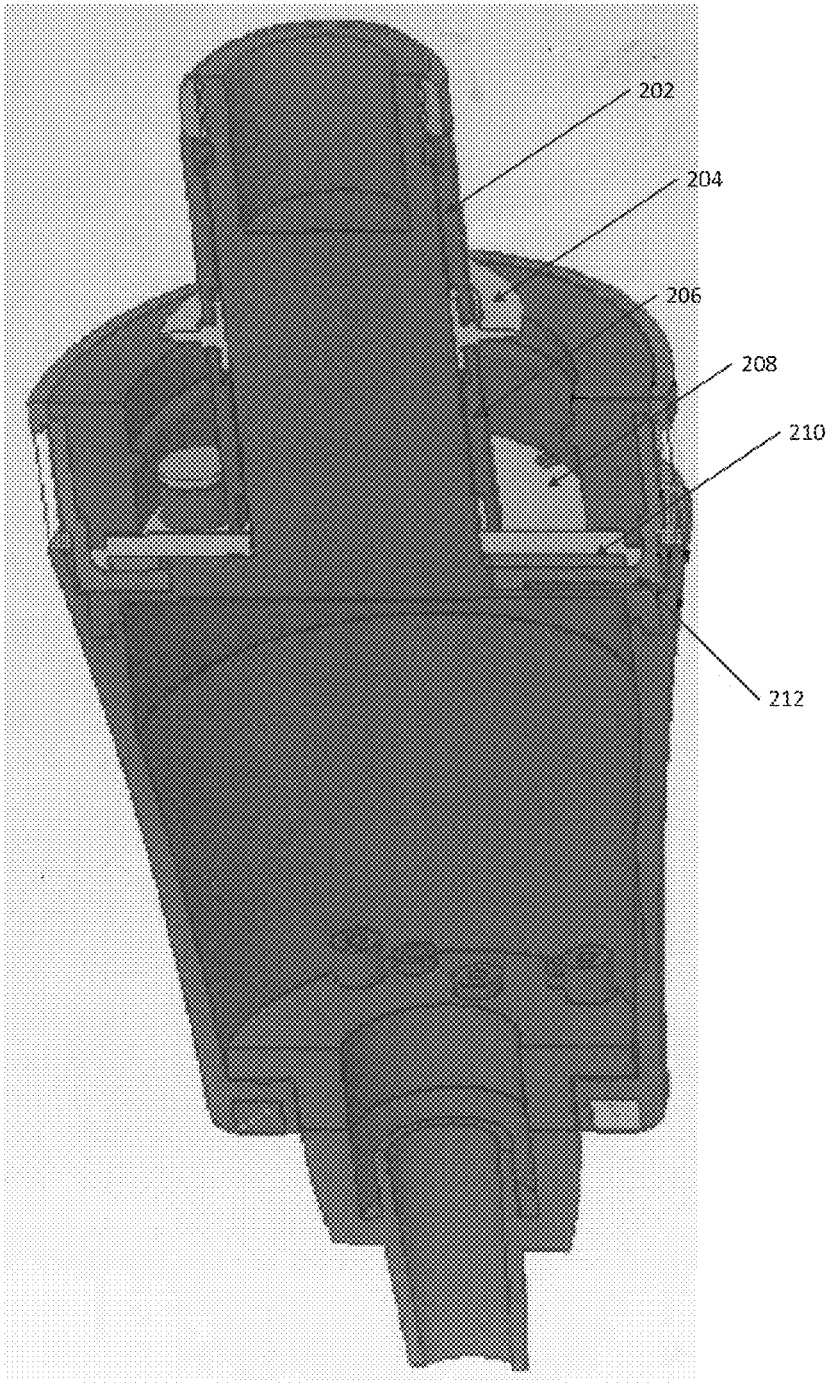
FIG. 2 shows a cross-sectional representation of a screw-on interface for bottle spouts according to an embodiment of the invention.

FIG. 2 shows a cross-sectional representation of a screw-on interface 200 for bottle spouts according to an embodiment of the invention. The components of the screw-on interface 200 that, when the bottle spout assembly is attached to a bottle, are positioned within an internal diameter of a bottle include the first spacer 206, the cork, 204, and second spacer 202. The components of the screw-on interface 200 that, when the bottle spout assembly is attached to a bottle, are positioned above or around the exterior diameter of the opening of a bottle include the threaded collar assembly 212, particularly the common disc 210 and O-ring 208.

Figure 3:
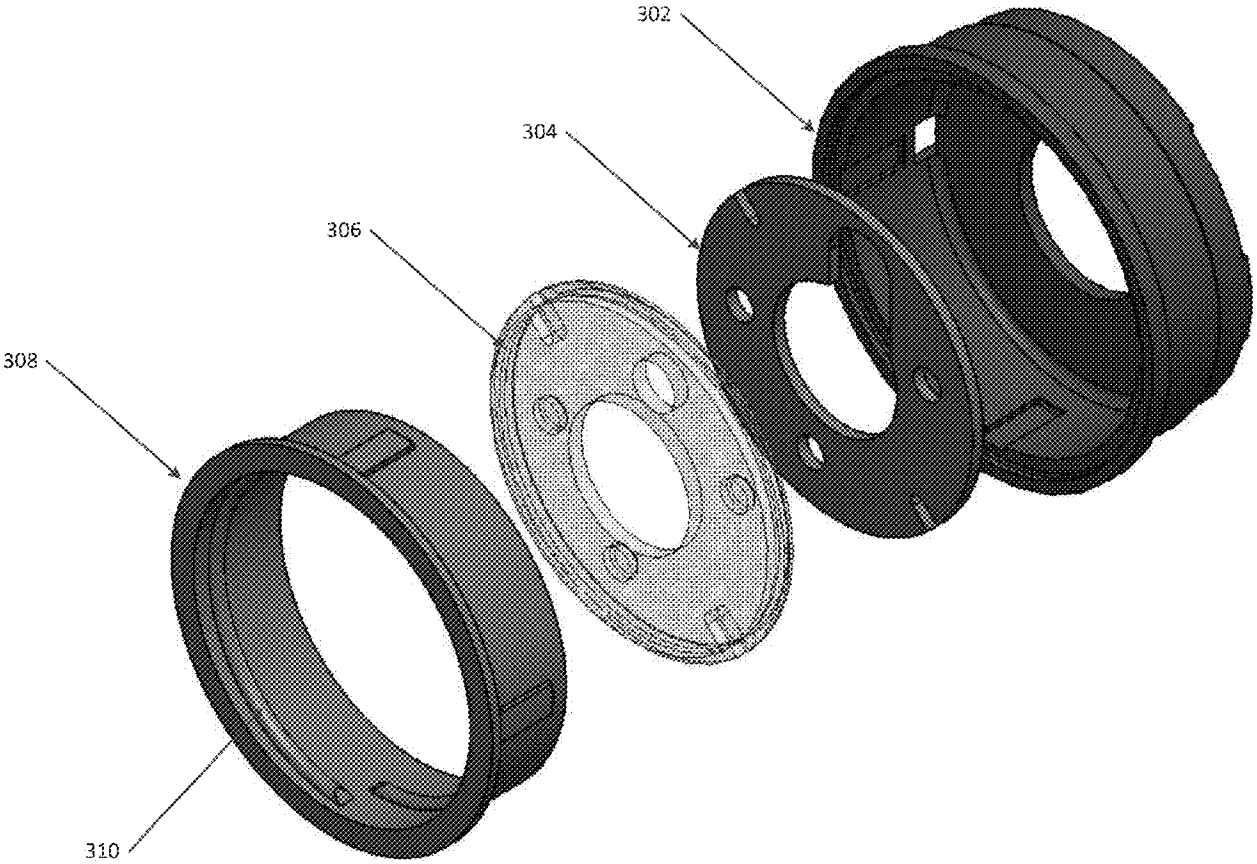
FIG. 3 shows an exploded view of the threaded collar of FIG. 2.

FIG. 3 shows an exploded view of a threaded collar 300 (element 108 in FIG. 2) for a screw-on interface for bottle spouts according to an embodiment of the invention. The threaded collar 300 is constructed from four pieces ultrasonically welded together, specifically an outer collar 302, a stainless steel disk 304, gasket 306, and a threaded insert 308. The threaded insert 308 is designed to have a different thread pattern or size appropriate to the application (i.e. dimensions of the bottle) to which the threaded collar 300 and the screw-on bottle interface is to be applied. Partial thread pattern 310 engages the exterior screw thread of a bottle to ensure a positive seal.

What is claimed is:

1. A screw-on interface for bottle spouts comprising:

a bottle spout, the bottle spout comprising an exterior shell, where the exterior shell includes a rim, and a stem, where the stem includes a region of threading;

a lens, which is mechanically coupled to the exterior shell rim;

a threaded collar, which is mechanically coupled to the lens, comprising an outer collar, a threaded insert, a gasket, and a disk;

a first spacer, a second spacer, and a cork, where the first spacer, second spacer, and cork are mechanically coupled to each other as an assembly, where the assembly is configured to mechanically couple and fit around the stem; and a nut which is mechanically coupled to the region of threading on the stem.

2. A screw-on interface for bottle spouts according to claim 1, wherein the disk is positioned between the outer collar and the threaded insert to thereby prevent damage to the screw-on interface resulting from over-tightening of the bottle spout.

3. A screw-on interface for bottle spouts according to claim 1, wherein the lens is transparent or semi-transparent.

4. A screw-on interface for bottle spouts according to claim 1, wherein the disk is made of stainless steel.

5. A screw-on interface for bottle spouts according to claim 1, wherein the outer collar, threaded insert, gasket, and disk of the threaded collar are ultrasonically welded together.

6. A screw-on interface for bottle spouts according to claim 1, wherein the disk includes a groove configured to couple with the threaded insert.

7. A screw-on interface for bottle spouts according to claim 1, wherein the first spacer and second spacer are each machined to have a counter-bore to attach and secure to the cork.

8. A screw-on interface for bottle spouts according to claim 1, wherein the threaded collar is configured to have a thread pattern configured to fit to a size of a bottle.

9. A screw-on interface for bottle spouts according to claim 8, wherein the threaded collar has a partial thread pattern configured ensure a positive seal on a bottle.

10. A screw-on interface for bottle spouts according to claim 8, wherein the threaded collar is configured to fit to a bottle of size 11, size 31, size 41, or size 51.

* * * * *